US008534017B1

(12) United States Patent
Schroeter

(10) Patent No.: US 8,534,017 B1
(45) Date of Patent: Sep. 17, 2013

(54) BASEBOARD SUPPORT DEVICES

(76) Inventor: Lloyd Schroeter, Lafayette, TN (US)

( * ) Notice: Subject to any disclaimer, the term of this patent is extended or adjusted under 35 U.S.C. 154(b) by 235 days.

(21) Appl. No.: 13/090,098

(22) Filed: Apr. 19, 2011

(51) Int. Cl.
*E04F 19/04* (2006.01)

(52) U.S. Cl.
USPC ..... 52/288.1; 52/261; 52/285.3; 52/718.03; 248/220.1; 248/300; 248/560; 24/563; 24/570

(58) Field of Classification Search
USPC ..... 52/70, 71, 287.1, 288.1, 290, 261, 52/489.1, 712, 717.03, 717.05, 718.03, 846, 52/285.3; 24/336, 458, 563, 570; 248/220.1, 248/300, 560; 403/397; 428/595, 603
See application file for complete search history.

(56) References Cited

U.S. PATENT DOCUMENTS

| | | | | | |
|---|---|---|---|---|---|
| 800,055 | A * | 9/1905 | Ayres | 138/163 |
| 1,250,594 | A * | 12/1917 | Knapp | 52/288.1 |
| 1,825,010 | A * | 9/1931 | Hayes | 52/288.1 |
| 2,214,187 | A * | 9/1940 | Swedman | 52/784.16 |
| 2,218,273 | A * | 10/1940 | Wilhoyte | 52/362 |
| 2,825,949 | A * | 3/1958 | Olsen | 52/714 |
| 3,302,350 | A * | 2/1967 | Brown et al. | 52/288.1 |
| 3,308,590 | A * | 3/1967 | Ettore et al. | 52/281 |
| 3,616,587 | A * | 11/1971 | Schafly | 52/287.1 |
| 3,688,459 | A * | 9/1972 | Mattix | 52/35 |
| 3,742,668 | A * | 7/1973 | Oliver | 52/288.1 |
| 3,783,931 | A * | 1/1974 | Assael | 160/327 |
| 3,811,241 | A * | 5/1974 | Mattix | 52/35 |
| 3,999,236 | A * | 12/1976 | Macauley | 5/282.1 |
| 4,339,898 | A * | 7/1982 | Pichette | 52/94 |
| 4,621,471 | A * | 11/1986 | Kuhr et al. | 52/288.1 |
| 4,660,333 | A * | 4/1987 | Romer | 52/302.3 |
| 4,727,815 | A * | 3/1988 | Miller | 108/42 |
| 4,887,324 | A * | 12/1989 | Cairns | 4/609 |
| 5,520,477 | A * | 5/1996 | Fink | 403/397 |
| 5,634,314 | A * | 6/1997 | Champagne | 52/712 |
| 5,732,747 | A * | 3/1998 | Holliday | 138/163 |
| 5,836,113 | A * | 11/1998 | Bachman | 52/94 |
| 5,927,023 | A * | 7/1999 | Kittilstad | 52/60 |
| 6,253,507 | B1 * | 7/2001 | Martino | 52/211 |
| 6,812,628 | B2 * | 11/2004 | Bucher | 313/404 |
| 7,594,368 | B2 * | 9/2009 | Kurz | 52/290 |
| 7,607,269 | B2 * | 10/2009 | Klein | 52/281 |
| 7,908,806 | B2 * | 3/2011 | Kaplan | 52/287.1 |
| 7,958,685 | B2 * | 6/2011 | Rowohlt | 52/287.1 |
| 2004/0194417 | A1 * | 10/2004 | Paul | 52/716.8 |
| 2006/0277853 | A1 * | 12/2006 | Dillon | 52/287.1 |
| 2011/0179733 | A1 * | 7/2011 | Picken | 52/242 |
| 2011/0230900 | A1 * | 9/2011 | Sarradon | 606/151 |

* cited by examiner

*Primary Examiner* — Robert Canfield
(74) *Attorney, Agent, or Firm* — Waddey & Patterson PC; Matthew C. Cox

(57) ABSTRACT

Devices and methods for preventing baseboard tilt associated with fastening a baseboard to a wall panel having a recessed edge. A baseboard support includes a corner bracket having first and second upright base members and having one or more flaps extending from an upright edge a base member. Each flap forms a flap angle with an adjacent portion of the bracket. Each flap is attached to the bracket at a resilient flap corner, or flap hinge. The baseboard support can be positioned in a corner in an upright position. A first baseboard can be positioned so that the baseboard end engages the first upright base member. A second baseboard can be positioned to engage the second upright base member, forming a mitered joint between the two baseboards. The baseboard support provides a stop that prevents each baseboard from tilting away from its corresponding wall panel and creating an unsightly gap. The flap or flaps allow the baseboard support to stand freely in the interior corner prior to baseboard positioning. Each flap may also provide a resilient force against a baseboard end to further prevent tilting. Methods of installing a baseboard and preventing baseboard tilt are also provided.

20 Claims, 8 Drawing Sheets

BASEBOARD SUPPORT DEVICES

BACKGROUND

1. Technical Field

The present invention relates generally to construction materials and more particularly to devices and methods for installing baseboards.

2. Background Art

Conventional drywall panels of the types used in residential and commercial buildings for walls are typically fastened to underlying studs or beams. Multiple drywall panels can be mounted adjacent one another vertically and/or horizontally to form a wall. Standard drywall panels commonly include one or more tapered edges. When two drywall panels are positioned adjacent each other, a filler material such as a tape, plaster or mud can be applied to the tapered region between the panels to cover a seam or crack that may exist between the two panels. The tapered edges of the drywall panels provide a recess that can be filled with a filler material such as tape, plaster, mud or another suitable filler material without creating a bulge or protrusion from the plane of the wall.

When a conventional drywall panel is positioned adjacent a floor or a subfloor, the lower tapered edge running parallel to the floor creates a recess in the region where the panel approaches the floor or subfloor. The recess, or cavity, can extend back away from the wall surface a few millimeters or up to greater than a centimeter in some applications. Such a recess adjacent a floor is generally not necessary for accommodating a filler material as there is no panel joint nearby, but is necessarily present due to the tapered longitudinal edges found on conventional drywall panels.

Following drywall panel installation, baseboards are typically installed. When a baseboard is positioned against the lower edge of a drywall panel in the region near the floor or subfloor for fastening in place, a cavity is generally formed behind the baseboard between the baseboard and the tapered region of the drywall. An inflection position on the drywall panel where the tapered region meets the plane of the panel is typically located between the top edge of the baseboard and the bottom edge of the baseboard. Thus, the baseboard hides the tapered region, but the tapered region exists behind the baseboard. The inflection position acts as a tilting fulcrum against the baseboard when the baseboard is fastened to the drywall panel. The bottom edge of the baseboard has a tendency to be pushed into the cavity formed between the baseboard and the tapered region of the drywall panel. This can be referred to as baseboard tilt, wherein the top edge of the baseboard is pushed outward away from the wall, creating an undesirable gap between the top edge of the baseboard and the drywall panel. Such a gap is generally unacceptable in construction and must be corrected. When such gaps are formed, either the baseboard must be removed and reinstalled, or the gap must be filled with a material such as a caulking. Caulking is not an acceptable solution in many applications because the caulk has a tendency to shrink or crack over time, thereby revealing the gap and requiring further caulking.

Others have attempted to solve the problems associated with installing baseboards against tapered regions of drywall panels by placing small shims or supports between the back of the baseboard and the drywall panel. However, such shims are often merely scrap pieces of wood or cardboard and do not precisely fit the dimensions of the cavity between the drywall panel and the baseboard.

Thus, there is a continuing need in the art for improvements in devices and methods for installing baseboards.

BRIEF SUMMARY

One aspect of the present invention provides an apparatus for supporting a baseboard. The apparatus includes a corner bracket having first and second upright base members attached at a base member corner. A first flap extends from the first upright base member in some embodiments. The first flap prevents the bracket from falling over. The first flap is operable to resiliently engage the baseboard.

A further aspect of the present invention provides an apparatus for supporting a baseboard against a tapered region of a wall panel, the wall panel having a wall panel thickness. A corner bracket includes a first upright base member and a second upright base member interconnected at a base living hinge. A first flap is attached to the first upright base member at a first flap living hinge. A second flap is attached to the first upright base member at a second flap living hinge.

Yet another aspect of the present invention provides a wall assembly including a wall panel having a tapered lower edge; a baseboard positioned adjacent the wall panel; a cavity defined between the baseboard and the tapered lower edge; and a baseboard support disposed in the cavity. The baseboard support further includes a corner bracket having a first upright base member and a second upright base member attached to the first upright base member. A first flap extends from the first upright base member, and a second flap extending from the second upright base member.

Numerous other objects, features and advantages of the present invention will be readily apparent to those skilled in the art upon a reading of the following disclosure when taken in conjunction with the accompanying drawings.

DETAILED DESCRIPTION

Figure 1:
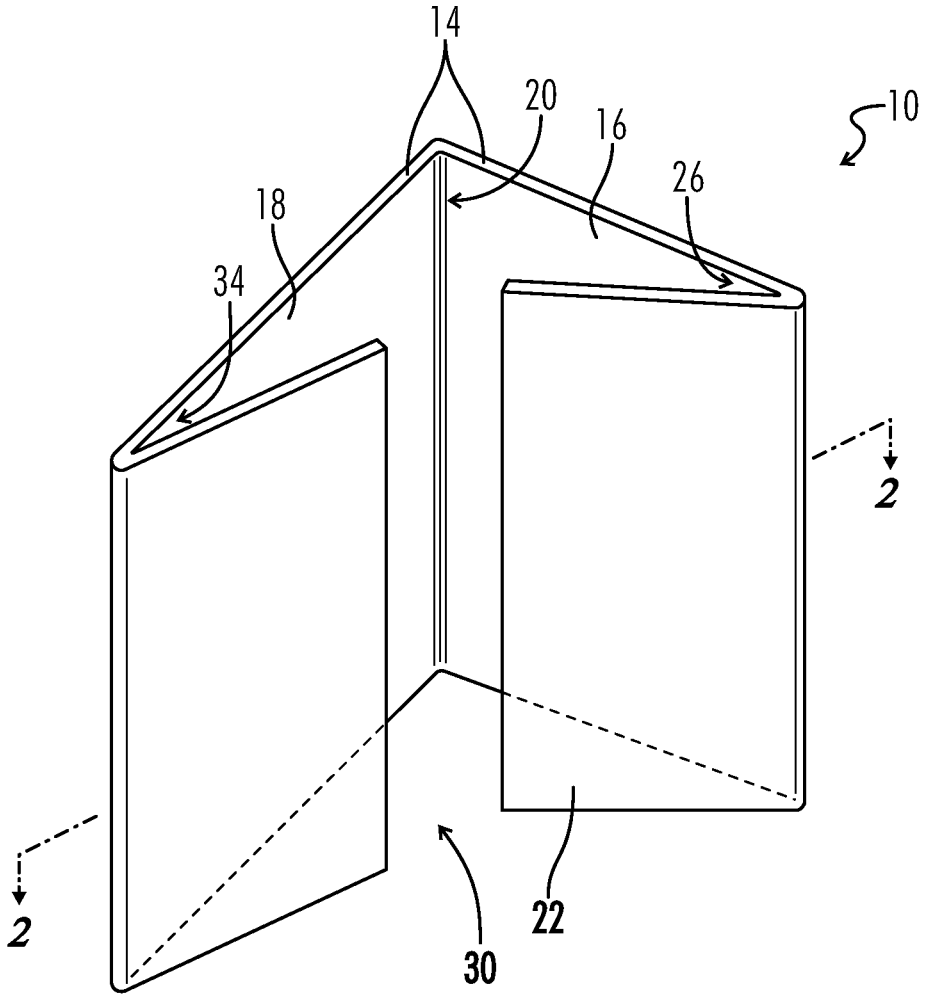
FIG. 1 illustrates a perspective view of an embodiment of a baseboard support in accordance with the present disclosure.

Referring now to the drawings, FIG. 1 illustrates a perspective view of an embodiment of an apparatus for supporting a baseboard, or baseboard support, designated by the numeral 10. In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 6:
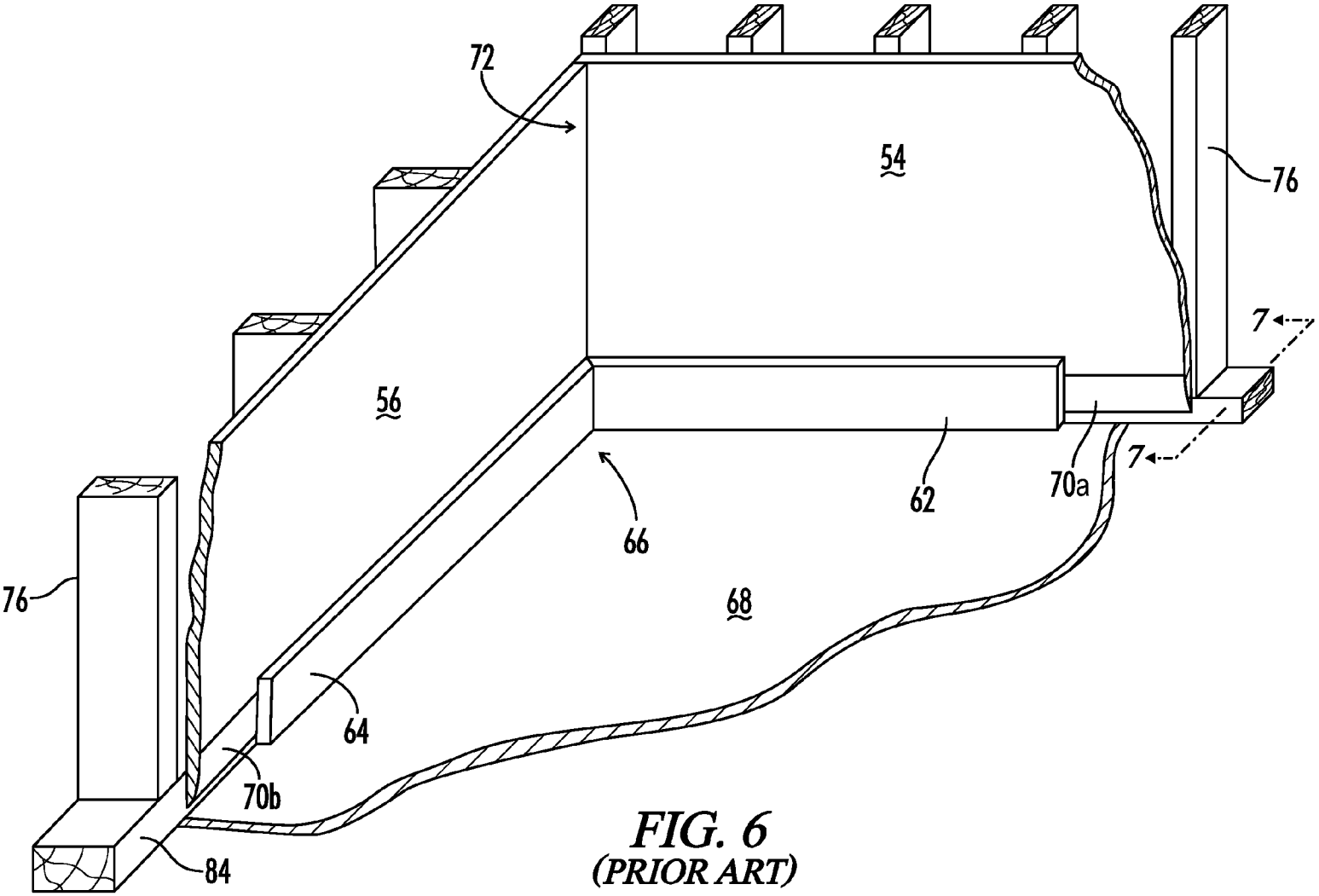
FIG. 6 (PRIOR ART)
FIG. 6 illustrates a partial perspective view of an embodiment of a wall assembly including an interior wall corner.

As seen in FIG. 6, a conventional wall assembly in some embodiments includes an interior wall corner 72 formed between a first wall panel 54 and a second wall panel 56. A plurality of wall studs 76 extend upward from one or more bottom plates 84 and support each wall panel 54, 56 from behind. Each wall panel 54, 56 can include a conventional drywall or sheet rock panel of the types typically used in residential and commercial construction. Each wall panel includes a tapered lower edge. For example, first wall panel 54 includes a first tapered lower edge 70*a*, and second wall panel 56 includes a second tapered lower edge 70*b*. A first baseboard 62 can be positioned against first wall panel 54 adjacent first tapered lower edge 70*a*, and a second baseboard 64 can be positioned against second wall panel 56 adjacent second tapered lower edge 70*b*. First and second baseboards 62, 64 meet at a mitered joint 66. Each baseboard 62, 64, generally rests against floor 68.

Figure 7:
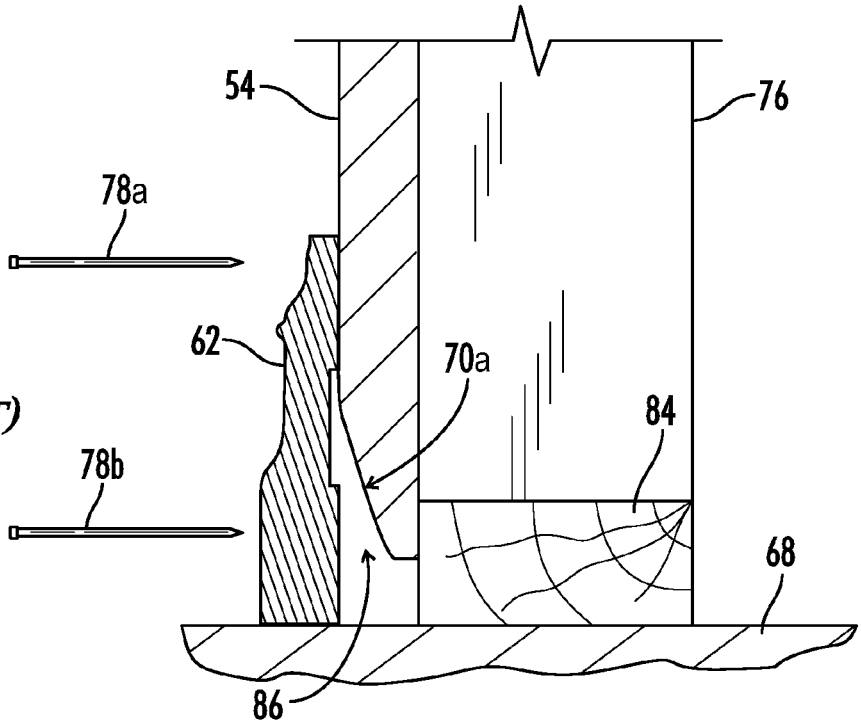
FIG. 7 (PRIOR ART)
FIG. 7 illustrates a prior art partial cross-sectional view of an embodiment of a baseboard engagement with a wall panel of Section 7-7 from FIG. 6.

Referring now to FIG. 7, a cavity 86 can be formed behind each baseboard due to the tape of the corresponding wall panel against which the baseboard is positioned. It is understood that, in some applications, cavity 86 can be formed not by a tapered region but by another irregularity in the underlying wall panel such as a void or a wall panel edge that ends before the edge meets floor 68. During conventional baseboard installation procedures, baseboard 62 is positioned against wall panel 54 as seen in FIG. 7. A first baseboard fastener 78*a*, such as but not limited to a finishing nail, can be nailed into the upper half of baseboard 62 to secure baseboard 62 to the wall panel 54. First baseboard fastener 78*a* is generally aligned with one of the wall studs 76 in some applications.

Figure 8:
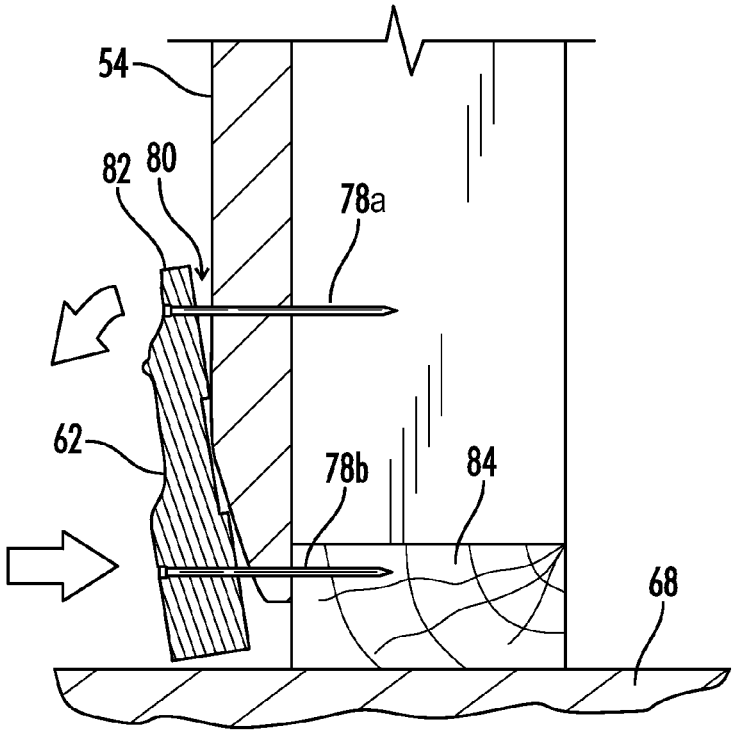
FIG. 8 (PRIOR ART)
FIG. 8 illustrates a partial cross-sectional view of the embodiment of a baseboard engagement with a wall panel of FIG. 7 showing a baseboard gap 80.

A second baseboard fastener 78*b*, such as but not limited to a second finishing nail, can be nailed into the lower half of baseboard 72, as seen in FIG. 8. When the second baseboard fastener 78*b* is driven through baseboard 62, the driving force may cause the baseboard 62 to move into cavity 86, or tilt, thereby causing the top baseboard edge 82 to lever away from the wall panel 54, creating a gap 80.

In many applications, a baseboard support in accordance with the present disclosure can be utilized during baseboard installation to prevent baseboard tilting as illustrated in FIG. 8. Referring further to FIG. 1, an embodiment of a baseboard support 10 includes a corner bracket 14 having a first upright base member 16 and a second upright base member 18. Each upright base member 16, 18 can include a substantially planar form in some embodiments. First and second upright base members 16, 18 are attached at a base member corner 20. A first flap 22 extends from first upright base member 16.

Figure 2:
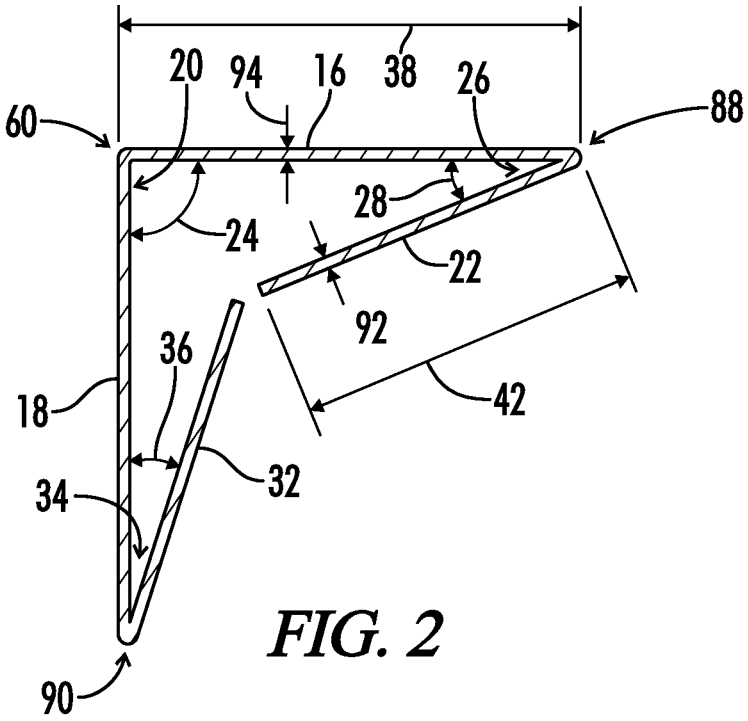
FIG. 2 illustrates a partial cross-sectional view of Section 2-2 of an embodiment of the baseboard support of FIG. 1.
Figure 3:
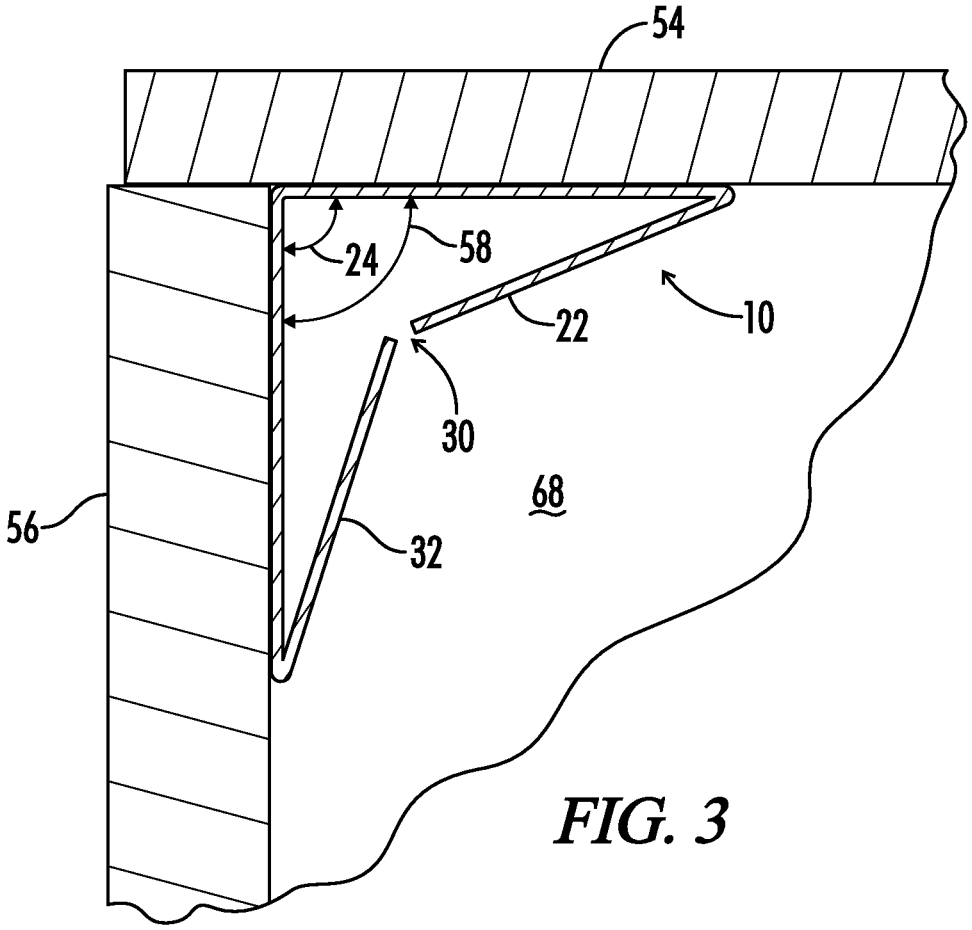
FIG. 3 illustrates a partial cross-sectional view of an embodiment of an interior wall corner having an embodiment of a baseboard support disposed therein.

Base member corner 20 in some embodiments forms a base member corner angle 24, seen in FIG. 2. In some embodiments, base member corner angle 24 is between about twenty and about one-hundred-eighty degrees. Baseboard support 10 is generally configured to be positioned on a floor or a subfloor in an upright position as seen in FIG. 1 at an interior corner location between adjacent wall panels. Base member corner angle 24 is generally configured to correspond to the interior corner angle between the adjacent wall panels. For example, as seen in FIG. 3, a first wall panel 54 and a second wall panel 56 form an interior wall corner angle 58. Interior wall corner angle 58 in many applications is about a ninety degree angle. However, in other applications, interior wall corner angle 58 can vary and can be greater than or less than ninety degrees. Base member corner angle 24 is generally chosen to correspond to interior wall corner angle 58. In some embodiments, base member corner angle 24 is between about sixty degrees and about one-hundred-twenty degrees. In further embodiments, base member corner angle 24 is about ninety degrees. In additional embodiments, base member corner angle 24 is substantially equal to interior wall corner angle 58.

In some embodiments, baseboard support 10 includes a polymer, a plastic or a vinyl material. In some embodiments, baseboard support 10 includes a polymer such as but not limited to polyvinyl chloride, polyethylene, polypropylene or mixtures thereof. Referring again to FIG. 2, in some embodiments, a base living hinge 60 is formed between first and second base members 16, 18. Base living hinge 60 includes an integrally formed bridge between first and second base member 16, 18 and allows first and second base members 16, 18 to flex, or hinge, relative to each other along the intersection of first and second base members 16, 18 at living hinge 60. During use, a user can manually force first and second base members 16, 18 closer together or further apart, thereby increasing or decreasing base member corner angle 24 to correspond more closely with interior wall corner angle 58. As such, a single baseboard support 10 can include an initial base member corner angle 24 and can be manipulated to include a new base member corner angle that is larger or smaller than the initial base member corner angle 24. Due to its flexible material composition, in some embodiments, baseboard support 10 may at least partially retain the new base member corner angle.

During use, in some embodiments, baseboard support 10 may be manipulated such that base member corner angle 24 is from about twenty degrees to about one-hundred-eighty degrees. When baseboard support 10 is configured such that base member corner angle 24 is about one-hundred-eighty degrees, baseboard support 10 may be used to support a scarf joint or other type of end-end joint between two baseboards along a wall panel. Additionally, when baseboard support 10 is configured such that base member corner angle 24 is about one-hundred-eighty degrees, baseboard support 10 may be used to provide an intermediate support along a length of a single baseboard.

A feature of the present invention is a baseboard support that is able to stand freely on a floor or subfloor surface. A simple bracket having only first and second upright base members has tendency to fall over away from the wall or tilt during baseboard installation. In some embodiments, the present invention provides one or more legs or flaps 22, 32, seen in FIGS. 1 and 2, that extend from the upright base members 16,18 for preventing the baseboard support 10 from falling over when positioned on a floor or subfloor. Referring again to FIG. 2, in some embodiments a first flap 22 extends from the first upright base member 16 at a first flap corner 26. First flap corner 26 defines a first flap corner angle 28. In some embodiments, the first flap corner angle 28 is no greater than about ninety degrees. First flap corner angle 28 can include an acute angle. In a preferred embodiment, first flap corner angle 28 is less than about forty-five degrees. In a more preferred embodiment, first flap corner angle 28 is no greater than about thirty degrees.

First flap 22 provides a stand for hands-free placement of baseboard support 10 on a subfloor 68, seen in FIG. 3, in an interior wall corner. First flap 22 generally keeps baseboard support 10 from falling over when placed in the interior wall corner. As such, while using baseboard support 10 in some applications, a worker may have both hands free to position and fasten the baseboard in place.

Also seen in FIGS. 1-5, a second flap 32 extends from second upright base member 18. Second flap 32 is attached to second upright base member 18 at a second flap corner 34. Second flap corner 34 defines a second flap corner angle 36. In some embodiments, the second flap corner angle 36 is no greater than about ninety degrees. In further embodiments, the second flap corner angle 36 is less than about forty-five degrees. In yet another embodiment, the second flap corner angle 36 is about thirty degrees.

In some applications, baseboard support 10 can be manually configured to adjust one or more angles between adjacent members. In some embodiments, corner bracket 14 includes a first upright base member 16 and a second upright base member 18 interconnected at a base living hinge 60, seen in FIG. 2. Base living hinge 60 forms an integral joint between first and second upright base members 16, 18. Similarly, a first flap living hinge 88 can be formed between first flap 22 and first upright base member 16. First flap living hinge 88 forms an integral joint between first flap 22 and first upright base member 16. First flap living hinge 88 allows first flap 22 to move toward first upright base member 16 when a baseboard is pressed against first flap 22. Also, a second flap living hinge 90 can be formed between second flap 32 and second upright base member 18. Second flap living hinge 90 forms an integral joint between second flap 32 and second upright base member 18. Second flap living hinge 90 allows second flap 32 to move toward second upright base member 18 when a baseboard is pressed against second flap 32.

Figure 4:
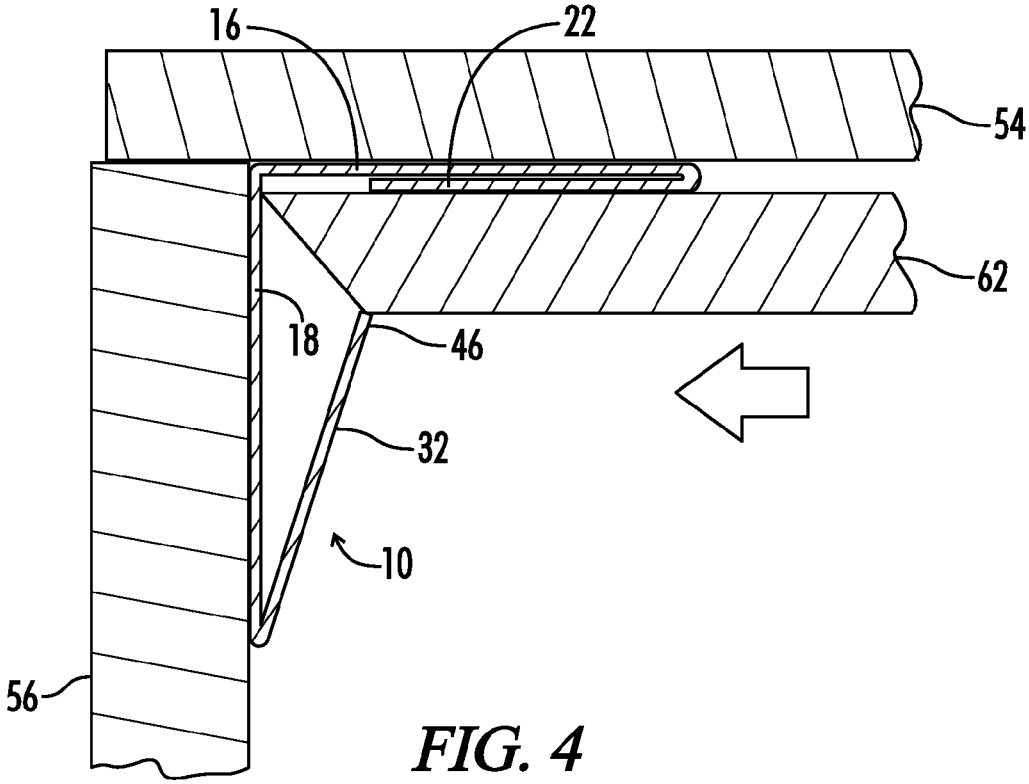
FIG. 4 illustrates a partial cross-sectional view of an embodiment of an interior wall corner including the baseboard support of FIG. 3 and a first baseboard engaging the first flap of the baseboard support.

In some embodiments, first flap 22 generally includes a first flap width 42. First upright base member 16 includes a base member width 38. In some embodiments, first flap width 42 is less than base member width 38. As seen in FIG. 1, a flap opening 30 can be defined between first flap 22 and second flap 32. Flap opening 30 generally allows insertion of a baseboard end between first flap 22 and second flap 32. For example, as seen in FIG. 3 and FIG. 4, a baseboard support 10 is positioned in an interior wall corner such that flap opening 30 generally faces away from the interior wall corner. A first baseboard 62 can be pressed against first flap 22 and slid toward second upright base member 18. In some embodiments, second flap 32 includes a second flap end 46 that may engage the first baseboard 62 when first baseboard 62 is engaged with baseboard support 10. Second flap end 46 in some embodiments can clip or secure baseboard support 10 to first baseboard 62. In some embodiments, baseboard support 10 is configured to clip to a baseboard by providing a distance between second flap end 46 and first upright base member 16 that is equal to or slightly less than the thickness of first baseboard 62.

Figure 5:
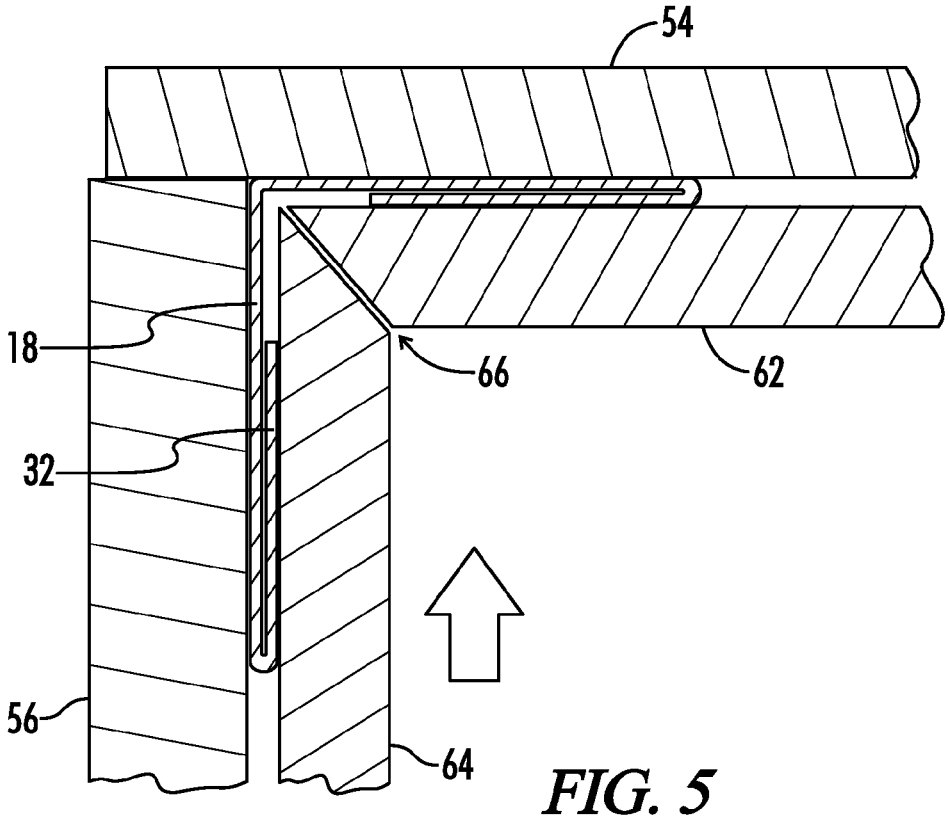
FIG. 5 illustrates a partial cross-sectional view of the embodiment of an interior wall corner and baseboard support of FIG. 4 including a second baseboard engaging the second flap of the baseboard support and forming a mitered baseboard joint with the first baseboard.

Referring now to FIG. 5, a second baseboard 64 can be pressed against second flap 32, thereby causing second flap 32 to hinge about second flap living hinge 90 toward second upright base member 18. As such, a mitered baseboard joint 66, or molding joint, can then be formed between first baseboard 62 and second baseboard 64.

Figure 9:
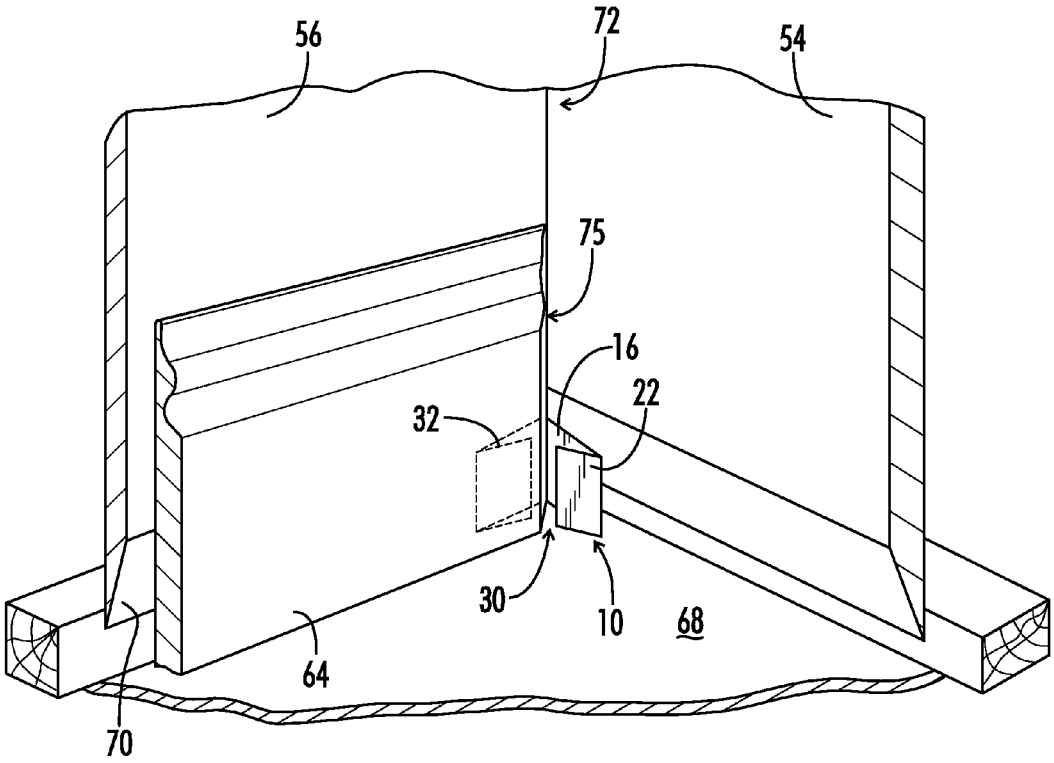
FIG. 9 illustrates a partial perspective view of an embodiment of a baseboard support positioned in an interior wall corner engaged by a baseboard.

Referring now to FIG. 9, an embodiment of a baseboard support 10 is generally illustrated partially installed in an interior wall corner 72. In this embodiment, second baseboard 64 can be positioned against second flap 32 while baseboard support 10 is installed in the corner between first and second wall panels 54, 56. In this embodiment, second flap 32 can be partially or fully depressed by second baseboard 64. In this embodiment, mitered edge 75 can be inserted into flap opening 30 between first and second flaps 22, 32. From this position, second baseboard 64 is unable to tilt because first upright base member 16 engages floor 68.

Figure 10:
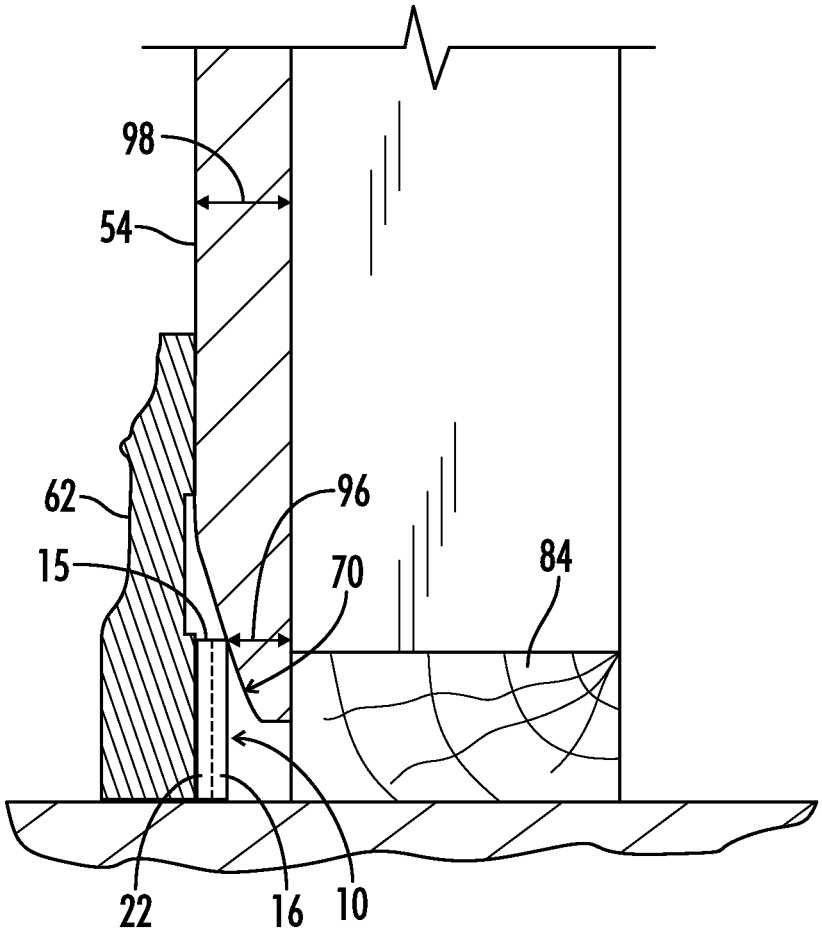
FIG. 10 illustrates a partial cross-sectional view of an embodiment of a baseboard support positioned between a baseboard and a wall panel.

Referring now to FIG. 10, in some embodiments, a baseboard support 10 includes an apparatus for supporting a baseboard 62 against a wall panel 54. Wall panel 54 includes a nominal wall panel thickness 98. Baseboard support 10 includes a corner bracket 14, seen in FIG. 1, including a first upright base member 16 and a second upright base member 18 interconnected at a base living hinge 60, seen in FIG. 2. A first flap 22 is attached to the first upright base member 16 at a first flap living hinge 88. In some embodiments, a second flap 32 is attached to the second upright base member at a second flap living hinge 90. First flap 22 defines a first flap thickness 92. First upright base member 16 defines a first upright base member thickness 94. In some embodiments, first flap thickness 92 and first upright base member thickness 94 are substantially equal. In some embodiments, first flap thickness 92 and first upright base member thickness 94 are between about 0.15 to about 2.0 millimeters.

Referring further to FIG. 10, in some embodiments, first upright base member 16 includes an upper base member edge 15. Upper base member edge 15 is aligned with a location on tapered region 70 of wall panel 54. Tapered region 70 defines a local tapered region thickness 96 aligned with upper base member edge 15. In some embodiments, the sum of first flap thickness 92 plus the first upright member thickness 94 is substantially equal to the difference between the wall panel thickness 98 and the local tapered region thickness 96. As such, first flap 22 is pressed against first upright base member 16 when baseboard 62 engages baseboard support 10.

In a further embodiment, the sum of the first flap thickness 92 plus the first upright member thickness 94 is less than the difference between the wall panel thickness 98 and the local tapered region thickness 96. In such embodiments, first flap 22 does not fully engage first upright base member 16 when baseboard 62 engages baseboard support 10. First flap 22 may resiliently engage baseboard 62 when baseboard 62 is fully engaged with baseboard support 10. It is appreciated that some flexing may occur in baseboard support 10 to conform to the specific geometry of the interior wall corner and baseboards. This feature includes one advantage of the present invention, as irregular geometries may be accommodated by baseboard support 10.

In some embodiments, baseboard support 10 includes a single piece of injection molded plastic with three folds. A first fold is positioned between the first and second base members 16, 18. A second fold is positioned between the first flap 22 and the first base member 16. A third fold is positioned between the second flap 32 and the second base member.

Another feature of the baseboard support 10 in some embodiments provides a device that can be readily modified by a worker using a tool such as shears or a knife. Baseboard support 10 in some embodiments includes a polymer or a plastic material that can be custom shaped by a worker to fit a particular application. For example, a flap can be cut off, or an indentation can be cut in an upper or lower edge of a base member or a flap to accommodate an existing structure. In some applications, when a baseboard is pressed against a flap on baseboard support 10, the flap may contact its corresponding base member and may create a support that is too thick for the baseboard to rest flush against the wall support. In such applications, baseboard support 10 is configured such that one or both flaps may be cut off by a user using a simple tool such as a knife or shears.

In some embodiments, baseboard support 10 includes a height between about one and about two inches. In further embodiments, baseboard support 10 includes a height of about one and three-eighths inches. In some embodiments, one or both base member widths can be about one and one-fourth inches.

After installation of baseboard support 10, the device may be left in place permanently behind the baseboard or molding. Baseboard support 10 is generally compatible with a variety of floor coverings including carpet, hardwood flooring, laminate flooring, tile, etc.

In a further embodiment, the present disclosure provides a method of installing a baseboard. The method includes the steps of: (a) placing a baseboard support in an interior corner, the baseboard support including first and second base members interconnected at a living hinge, a first flap extending from the first base member and a second flap extending from the second base member; (b) positioning a first baseboard against the first flap; and (c) positioning a second baseboard against the second flap.

Figure 11:
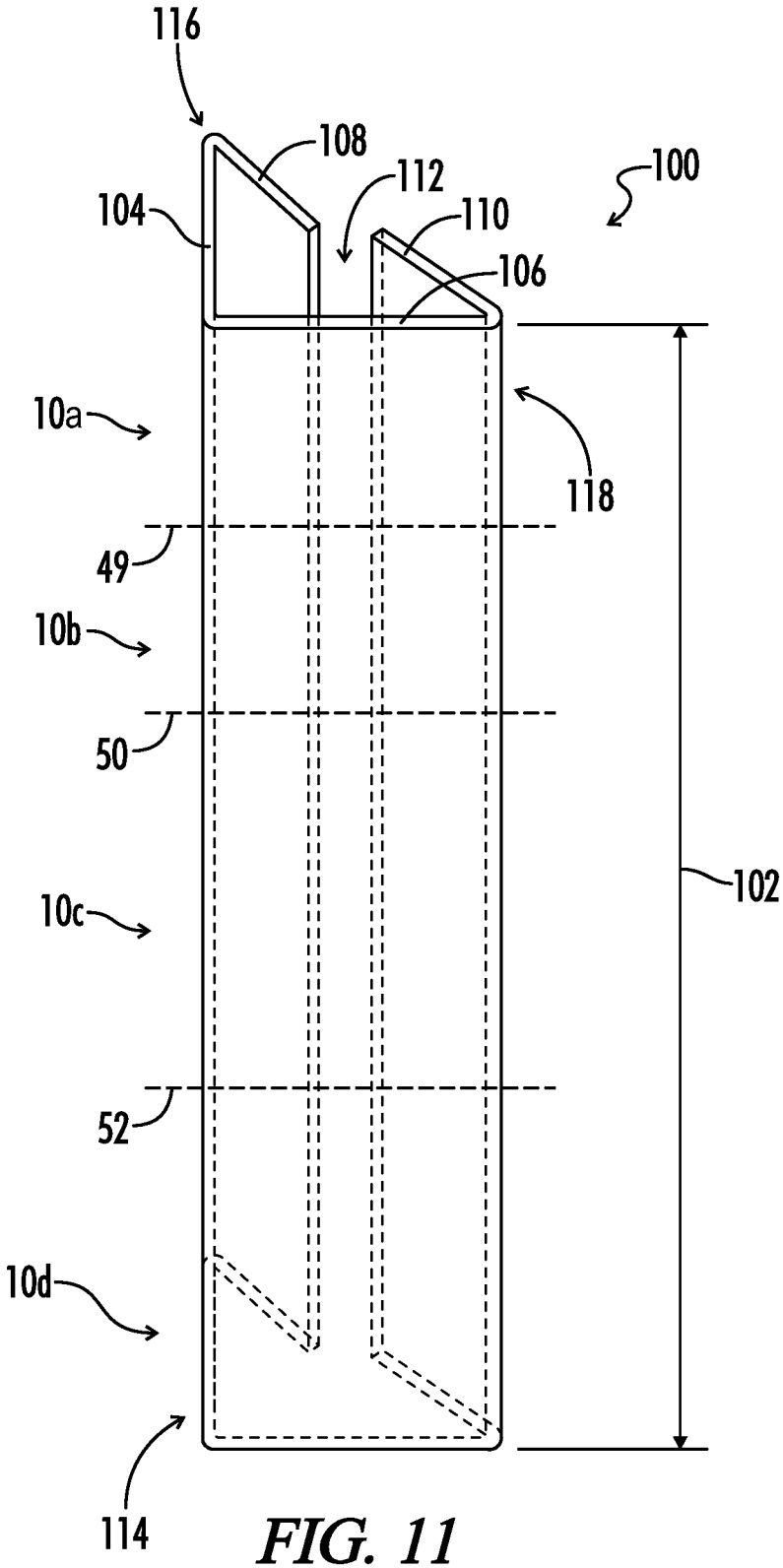
FIG. 11 illustrates a perspective view of an embodiment of a baseboard support blank.

Referring now to FIG. 11, a further embodiment of the present invention provides a baseboard support blank 100 having a blank height 102 at least twice first upright base member width 38, seen in FIG. 2. Baseboard support blank 100 generally includes an elongated version of a baseboard support 10. Baseboard support blank 100 provides a blank that can be cut to a user's particular needs. For example, a blank 100 can be cut at a first cut location 49, producing a first baseboard support 10*a*. Blank 100 can be subsequently cut at a second cut location 50, producing a second baseboard support 10*b*. Blank 100 can then be cut at a third cut location 52, producing third and fourth baseboard supports 10*c*, 10*d*.

Baseboard blank 100 can include thermosetting or thermoforming polymer material and can be formed by various material processing techniques known in the art, including but not limited to injection molding or extrusion. Baseboard blank 100 generally includes a first blank base member 104 attached to a second blank base member 106 at a first blank joint 114. In some embodiments, first blank joint 114 is a living hinge. A first blank flap 108 is attached to first blank base member 104 at a second blank joint 116. Second blank joint 116 in some embodiments is a living hinge. A second blank flap 110 is attached to second blank base member 106 at a third blank joint 118. In some embodiments, third blank joint 118 is also a living hinge. As such, first and second blank flaps 108, 110 are resiliently repositionable relative to first and second blank base members 104, 106, respectively.

Thus, although there have been described particular embodiments of the present invention of a new and useful Baseboard Support Device and Methods, it is not intended that such references be construed as limitations upon the scope of this invention except as set forth in the following claims.

What is claimed is:

1. A wall assembly, comprising:
a wall panel having a tapered lower edge;
a baseboard positioned adjacent the wall panel;
a cavity defined between the baseboard and the tapered lower edge; and
a baseboard support disposed in the cavity, the baseboard support further comprising:
a corner bracket having a first upright base member and a second upright base member attached to the first upright base member;
a first flap extending from the first upright base member; and
a second flap extending from the second upright base member.

2. The assembly of claim 1, wherein:
the angle between the first flap and the first upright base member is less than about forty-five degrees.

3. The assembly of claim 1, wherein:
the angle between first upright base member and the second upright base member is between about 20 degrees and about 180 degrees.

4. The assembly of claim 1, further comprising:
a flap opening defined between the first and second flaps.

5. The assembly of claim 1, further comprising:
a base living hinge positioned between the first and second upright base members;
a first flap living hinge positioned between the first flap and the first upright base member; and
a second flap living hinge positioned between the second flap and the second upright base member.

6. An apparatus for supporting a baseboard against a tapered region of a wall panel, the wall panel having a wall panel thickness, comprising:
a corner bracket including a first upright base member and a second upright base member interconnected at a base living hinge;
a first flap attached to the first upright base member at a first flap living hinge;
a second flap attached to the first upright base member at a second flap living hinge;
the first flap defining a first flap thickness, and the first upright base member defining a first upright base member thickness; and
the first upright base member including an upper base member edge configured for alignment at a location on the tapered region, wherein the tapered region defines a local tapered region thickness at the location of alignment with the upper base member edge,
wherein the sum of the first flap thickness plus the first upright base member thickness is substantially equal to the difference between the wall panel thickness and the local tapered region thickness.

7. The apparatus of claim 6, wherein the first flap thickness and the first upright base member thickness are substantially equal.

8. The apparatus of claim 6, further comprising:
a base member corner located between the first and second upright base members, the base member corner forming a base member corner angle between about 20 degrees and about 180 degrees.

9. The apparatus of claim 8, wherein the base member corner angle is about 90 degrees.

10. The apparatus of claim 9, further comprising:
a first flap corner between the first flap and the first upright base member, the first flap corner defining a first flap corner angle,
wherein the first flap corner angle is no greater than about 90 degrees.

11. The apparatus of claim 10, wherein the first flap corner angle is less than about 45 degrees.

12. The apparatus of claim 11, wherein the second flap extends from the second upright base member at a second flap corner, the second flap corner defining a second flap corner angle no greater than about 90 degrees.

13. The apparatus of claim 12, wherein the second flap corner angle is less than about 45 degrees.

14. An apparatus for supporting a baseboard against a tapered region of a wall panel, the wall panel having a wall panel thickness, comprising:

a corner bracket including a first upright base member and a second upright base member interconnected at a base living hinge;

a first flap attached to the first upright base member at a first flap living hinge;

a second flap attached to the first upright base member at a second flap living hinge;

the first flap defining a first flap thickness, and the first upright base member defining a first upright base member thickness; and the first upright base member including an upper base member edge configured for alignment at a location on the tapered region, wherein the tapered region defines a local tapered region thickness at the location of alignment with the upper base member edge, wherein the sum of the first flap thickness plus the first upright base member thickness is less than the difference between the wall panel thickness and the local tapered region thickness.

15. The apparatus of claim 14, wherein the first flap thickness and the first upright base member thickness are substantially equal.

16. The apparatus of claim 14, further comprising a base member corner located between the first and second upright base members, the base member corner forming a base member corner angle between about 20 degrees and about 180 degrees.

17. The apparatus of claim 16, wherein the base member corner angle is about 90 degrees.

18. The apparatus of claim 17, further comprising:

a first flap corner between the first flap and the first upright base member, the first flap corner defining a first flap corner angle, wherein the first flap corner angle is no greater than about 90 degrees.

19. The apparatus of claim 18, wherein the first flap corner angle is less than about 45 degrees.

20. The apparatus of claim 19, wherein the second flap extends from the second upright base member at a second flap corner, the second flap corner defining a second flap corner angle no greater than about 90 degrees.

* * * * *